US006807969B1

(12) United States Patent
Wessinger et al.

(10) Patent No.: US 6,807,969 B1
(45) Date of Patent: Oct. 26, 2004

(54) METHOD FOR PROCESSING RECONSTITUTED TOBACCO

(75) Inventors: Eric W. Wessinger, Macon, GA (US); Kevin R. Korte, Louisville, KY (US); Robin Schlinger, Macon, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 10/217,509

(22) Filed: Aug. 13, 2002

(Under 37 CFR 1.47)

Related U.S. Application Data

(63) Continuation-in-part of application No. 09/812,632, filed on Mar. 20, 2001, now Pat. No. 6,595,216.

(51) Int. Cl.[7] ..... A24B 7/04
(52) U.S. Cl. ..... 131/374; 131/117; 131/370
(58) Field of Search ..... 131/108, 116, 131/117, 118, 322, 370, 374; 242/528; 83/29, 906, 650

(56) References Cited

U.S. PATENT DOCUMENTS

| | | | | |
|---|---|---|---|---|
| 678,371 | A | 7/1901 | Bender | |
| 1,874,902 | A | 8/1932 | Clyne | |
| 2,646,832 | A | 7/1953 | Papendick | |
| 2,769,734 | A | 11/1956 | Bandel | |
| 2,975,483 | A | 3/1961 | Cooper et al. | |
| 2,978,942 | A | 4/1961 | Re Casino | |
| 3,186,277 | A | 6/1965 | Brunner | |
| 4,267,752 | A | 5/1981 | Byrt et al. | |
| 4,787,402 | A | 11/1988 | Leonard | |
| 4,799,501 | A | 1/1989 | Liebe et al. | |
| 4,960,020 | A | 10/1990 | Reinhard | |
| 5,143,095 | A | 9/1992 | Lasch et al. | |
| 5,445,054 | A | 8/1995 | Pryor | |
| 5,724,998 | A | 3/1998 | Gellatly et al. | |
| 5,908,034 | A | 6/1999 | Adedeji | |
| 5,913,958 | A | 6/1999 | Balsells Ventura | |
| 6,595,216 | B1 * | 7/2003 | Wessinger | 131/117 |

FOREIGN PATENT DOCUMENTS

| | | |
|---|---|---|
| GB | 1 067 448 | 5/1967 |
| GB | 1 498 668 | 1/1978 |

* cited by examiner

*Primary Examiner*—Steven P. Griffin
*Assistant Examiner*—Carlos Lopez
(74) *Attorney, Agent, or Firm*—Charles G. Lamb; Middleton Reutlinger

(57) ABSTRACT

A method of processing reconstituted tobacco which reduces the attrition of reconstituted tobacco and increases the capacity of a primary processing facility by bypassing several conventional primary processing steps. This improved process allows reconstituted tobacco to bypass the primary processing steps up through final cut tobacco drying by separately cutting conventional reconstituted tobacco using a tobacco cutting machine. The method also includes the steps of drying reconstituted tobacco in a pre-dryer, forming sheets of reconstituted tobacco, cutting the sheets to a pre-selected width, transferring the sheets of pre-selected width to a primary processing facility, feeding the sheets of pre-selected width to a tobacco cutting machine, the sheets being cut to a pre-selected size, and blending the pre-selected size cut reconstituted tobacco with conventional cut tobacco.

10 Claims, 5 Drawing Sheets

METHOD FOR PROCESSING RECONSTITUTED TOBACCO

STATEMENT REGARDING RELATED APPLICATIONS

This application is a continuation in part of previously filed application Ser. No. 09/812,632 filed Mar. 20, 2001, now U.S. Pat. No. 6,595,216.

BACKGROUND OF THE INVENTION

1. Field of the Invention

This invention is directed to a process for reducing the attrition of reconstituted tobacco and increasing the manufacturing capacity of a primary processing facility and more particularly to processing reconstituted tobacco by bypassing several conventional primary processing steps.

2. Discussion of the Prior Art

In the manufacturing of smoking articles, and particularly cigarettes, tobacco leaves are generally aged at specific temperatures and humidity conditions for a pre-selected period of time. The tobacco leaves are then separated into lamina, stems and veins. The stems and veins are not suitable, without further processing, for use in a tobacco process. Thus, the stems, veins, dust, fines and other tobacco materials, are then reprocessed into a tobacco product referred to as reconstituted tobacco.

During the manufacture of reconstituted tobacco, a continuous sheet of reconstituted tobacco is produced which undergoes pre-drying, cutting into shapes approximating that of tobacco lamina, final drying, and compressed in shipping containers. This product is referred to as conventional reconstituted tobacco. The shipping containers are then transferred to a primary processing facility, unpacked, then processed through the primary processing facility along with tobacco lamina. The above steps described during the manufacture of reconstituted tobacco following pre-drying result in attrition of reconstituted tobacco, which generates fines, results in yield losses and reduces quality of conventional reconstituted tobacco, and quality of final cigarettes. The unpacking and processing which occurs at the primary processing facility results in additional attrition of reconstituted tobacco which further generates fines, results in further yield losses and further reduces quality of conventional reconstituted tobacco and quality of final cigarettes.

SUMMARY OF THE INVENTION

It is an object of the present invention to reduce attrition of the reconstituted tobacco through removal of several conventionally accepted steps in the processing of conventional reconstituted tobacco.

It is another object of the present invention to provide an improved process allowing reconstituted tobacco to bypass primary processing steps up through final cut tobacco drying by separately cutting conventional reconstituted tobacco using a tobacco cutting machine.

It is even a further object of the present invention to provide an improved process for the manufacture of reconstituted tobacco by eliminating the conventional steps of cutting reconstituted tobacco into shapes approximating that of tobacco lamina, processing through final drying and compressing in shipping containers at the reconstituted tobacco facility, and additionally bypassing the primary processing steps up through final cut-tobacco drying. That is after reconstituted tobacco exits a pre-drying operation it is cut into rectangular sheets having a width approximating that of the mouth opening of a tobacco cutter and a length appropriate for a tobacco cutter, then stacked for subsequent transfer to a primary processing facility, or alternatively, after reconstituted tobacco exits the pre-drying operation, the reconstituted tobacco is rolled into a single-sheet roll having the same width as a sheet of conventional reconstituted tobacco that exits pre-drying, called a master roll, wherein the master roll is subsequently cut into shorter rolls, called daughter rolls, the daughter rolls having a sheet width the same as the mouth opening of a tobacco cutter. The rectangular sheets of reconstituted tobacco or daughter rolls of reconstituted tobacco are transferred to a primary processing facility for further cutting and blending.

It is also an object of the present invention to provide a method for cutting reconstituted tobacco which allows the capacity of a primary tobacco processing facility, that processes reconstituted tobacco with lamina tobacco, to be increased without modifying or replacing processing equipment.

In carrying out the process of a first embodiment of the present invention, conventional reconstituted tobacco is shipped to and unpacked at the primary processing facility. The reconstituted tobacco is then loosened by conventional means allowing it to be fed to a tobacco cutting device, cut into shreds appropriate for blending with cut tobacco, then a pre-selected amount of cut reconstituted tobacco is blended with a pre-selected amount of cut tobacco for further processing.

In carrying out the process of a second embodiment of the present invention, a multiple-layer stack of sheets of reconstituted sheet tobacco in a semi-continuous or continuous web is fed directly to a tobacco cutting machine wherein the tobacco cutting device is a rotary drum cutter having controlled-strand length knives disposed along the outer periphery thereof for cutting the sheets of tobacco into well defined strands.

More particularly, the second embodiment of the present invention provides a process using sheets having a width approximately equal to the width of the mouth opening of a tobacco cutter wherein a plurality of said sheets are positioned on top of each other by simultaneously unrolling a plurality of rolls of single sheets; or alternatively, using sheets having a width approximately equal to the width of the mouth opening of a tobacco cutter by placing a plurality of said sheets on top of each other in an unrolled condition. The sheets of the reconstituted tobacco are then fed into a compression band of a tobacco cutter and a pre-selected amount of cut reconstituted tobacco is then blended with a pre-selected amount of cut tobacco for further processing.

All of the above outlined objectives are to be understood as exemplary only and many more objectives of the invention may be gleaned from the disclosure herein. Therefore, no limiting interpretation of the objectives noted are to be understood without further reading of the entire specification, claims, and drawings included herewith.

BRIEF DESCRIPTION OF THE DRAWINGS

A better understanding of the invention will be had upon reference to the following detailed description of the preferred embodiments and to the several views illustrated in the drawings wherein like numerals refer to like parts throughout the several views and wherein.

DETAILED DESCRIPTION OF THE PREFERRED EMBODIMENTS

Figure 7:
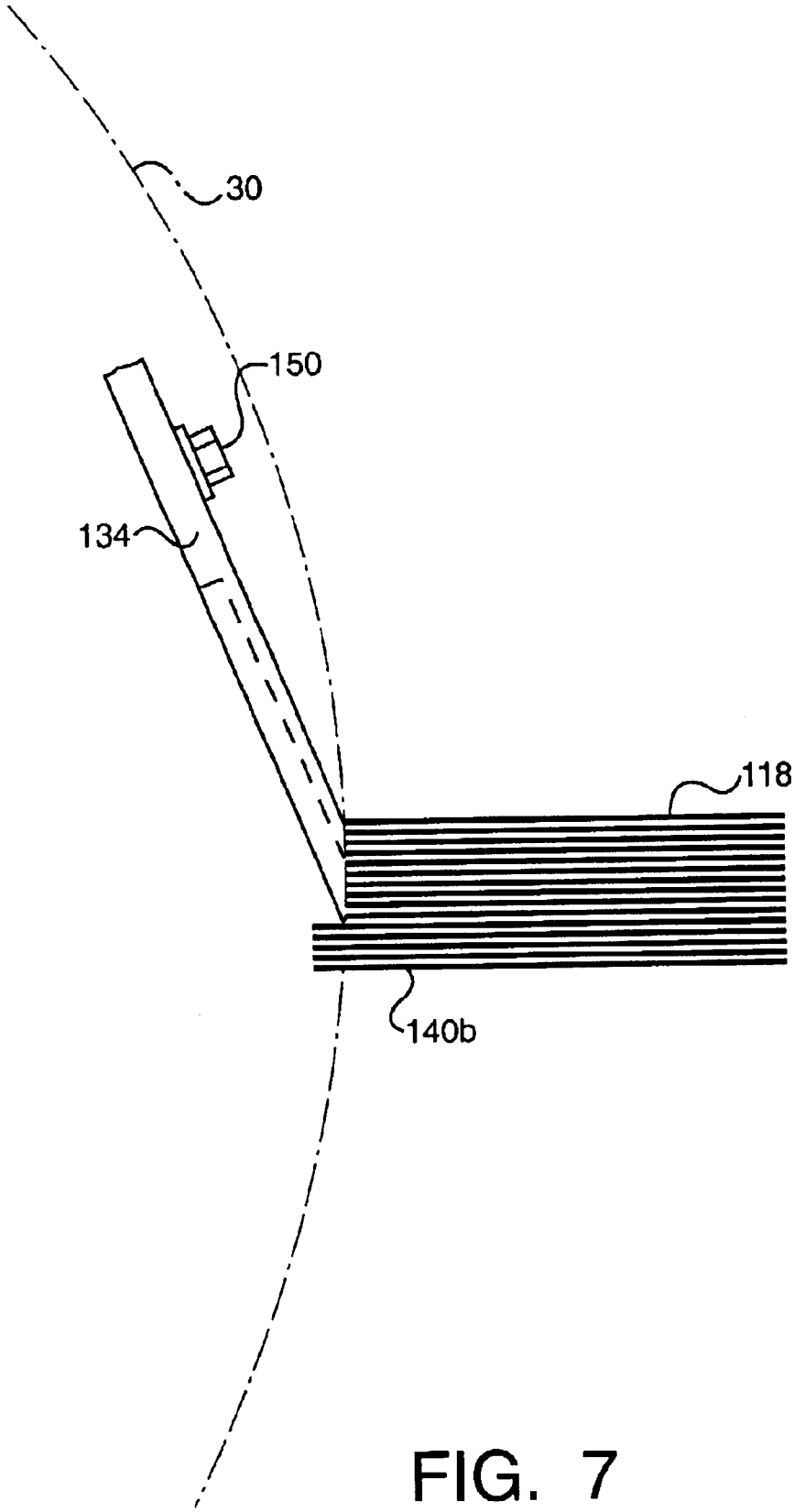
FIG. 7 is a schematic cross-section showing the cutting of a multiple layer stack of reconstituted tobacco by a rotary cutting drum; and, FIG. 8 shows the sequence of steps for processing reconstituted tobacco in accordance with the present invention.
Figure 8:
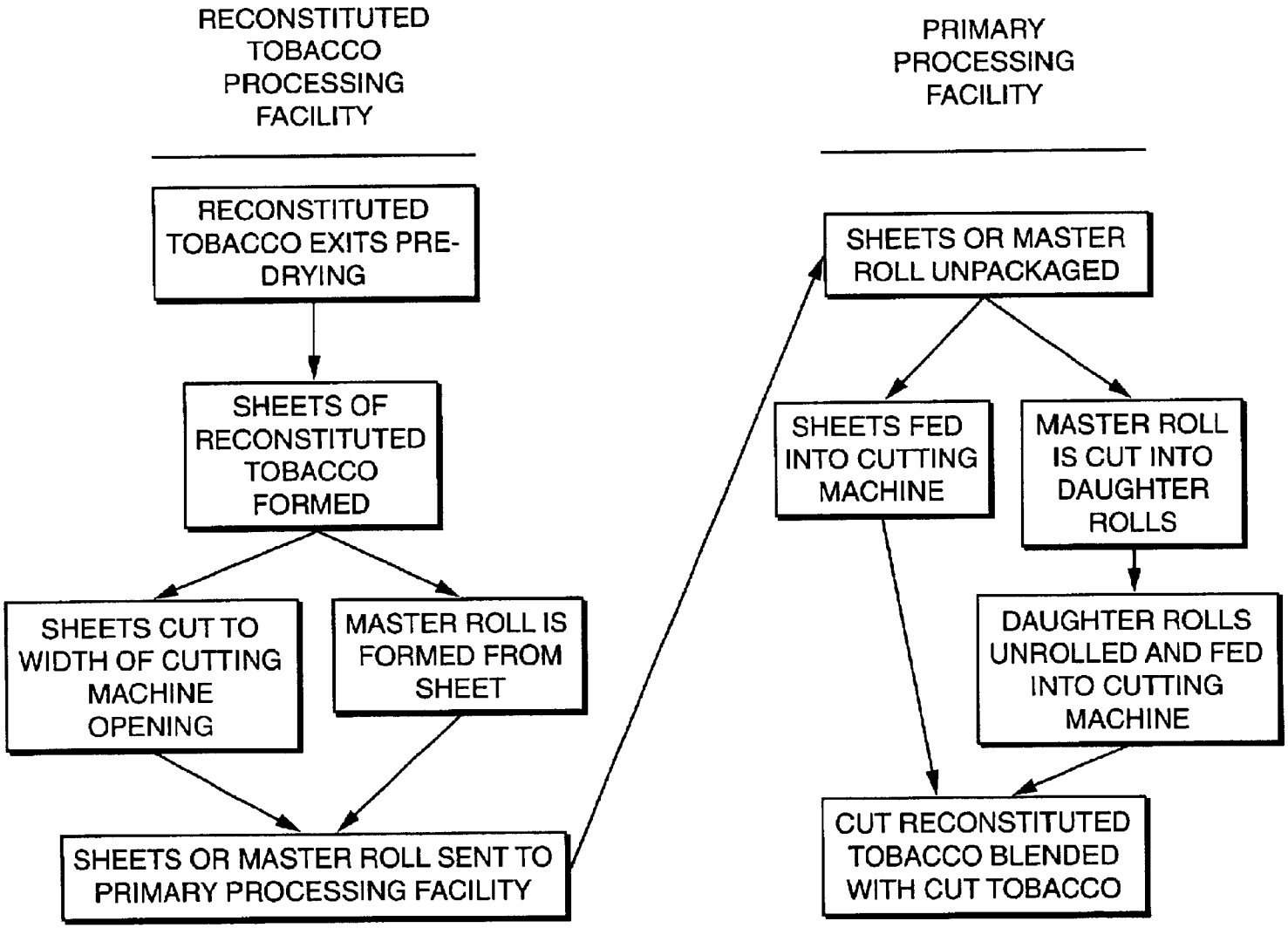

In order to process reconstituted tobacco, FIG. 8 shows the steps of a process which reduces attrition of reconstituted tobacco from a post pre-drying operation at a reconstituted tobacco processing facility through final cut tobacco drying at a primary processing facility. Moreover, the process increases capacity through final cut tobacco drying at a primary processing facility as well. Reconstituted tobacco in sheet form is obtained immediately after pre-drying at the reconstituted tobacco processing facility then separately cut into shreds appropriate for blending with cut tobacco. Thus, reconstituted tobacco is not processed with tobacco lamina at a primary processing facility through cut tobacco drying, but is instead blended with dried final cut tobacco. FIGS. 1–7 show cutting apparatus used in the process of FIG. 8.

In the pre-drying stage of processing reconstituted tobacco, sheets of reconstituted tobacco are dried by suspending the sheets in a tunnel and passing hot air through the tunnel. The moisture content of the sheet of reconstituted tobacco is lowered by the hot air to a range of between 13 and 15%. The reconstituted tobacco is then cut into rectangular sheets. The rectangular sheets are cut to a width approximating the width of a mouth opening of a tobacco cutting machine, using methods as will be recognized by one skilled in the art. The rectangular sheets are then packaged and sent to the primary processing facility. This process reduces attrition of reconstituted tobacco from after pre-drying at a reconstituted tobacco processing facility through final cut tobacco drying at a primary processing facility, as well as increasing capacity through final cut tobacco drying at the primary processing facility.

In an alternative process, which reduces attrition of reconstituted tobacco from after pre-drying at a reconstituted tobacco processing facility through final cut tobacco drying at a primary processing facility, as well as increasing capacity through final cut tobacco drying at a primary processing facility, reconstituted tobacco is rolled into single sheet rolls after exiting pre-drying, to form a master roll. Next, the master roll or rectangular reconstituted tobacco sheets are packaged and sent to the primary processing facility.

Figure 1:
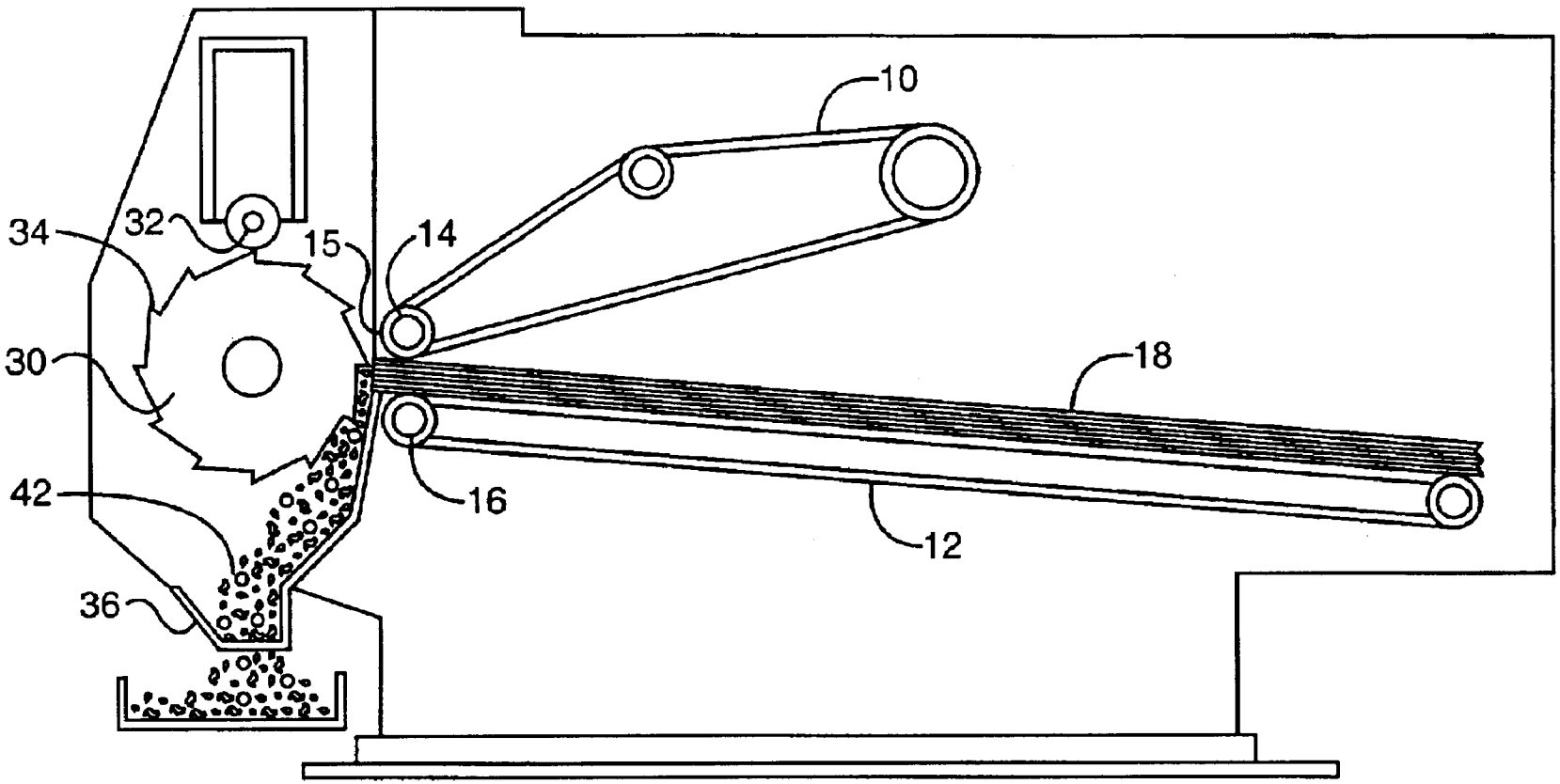
FIG. 1 is a schematic side elevational view of one embodiment of the cutting apparatus used in accordance with the present invention.
Figure 4:
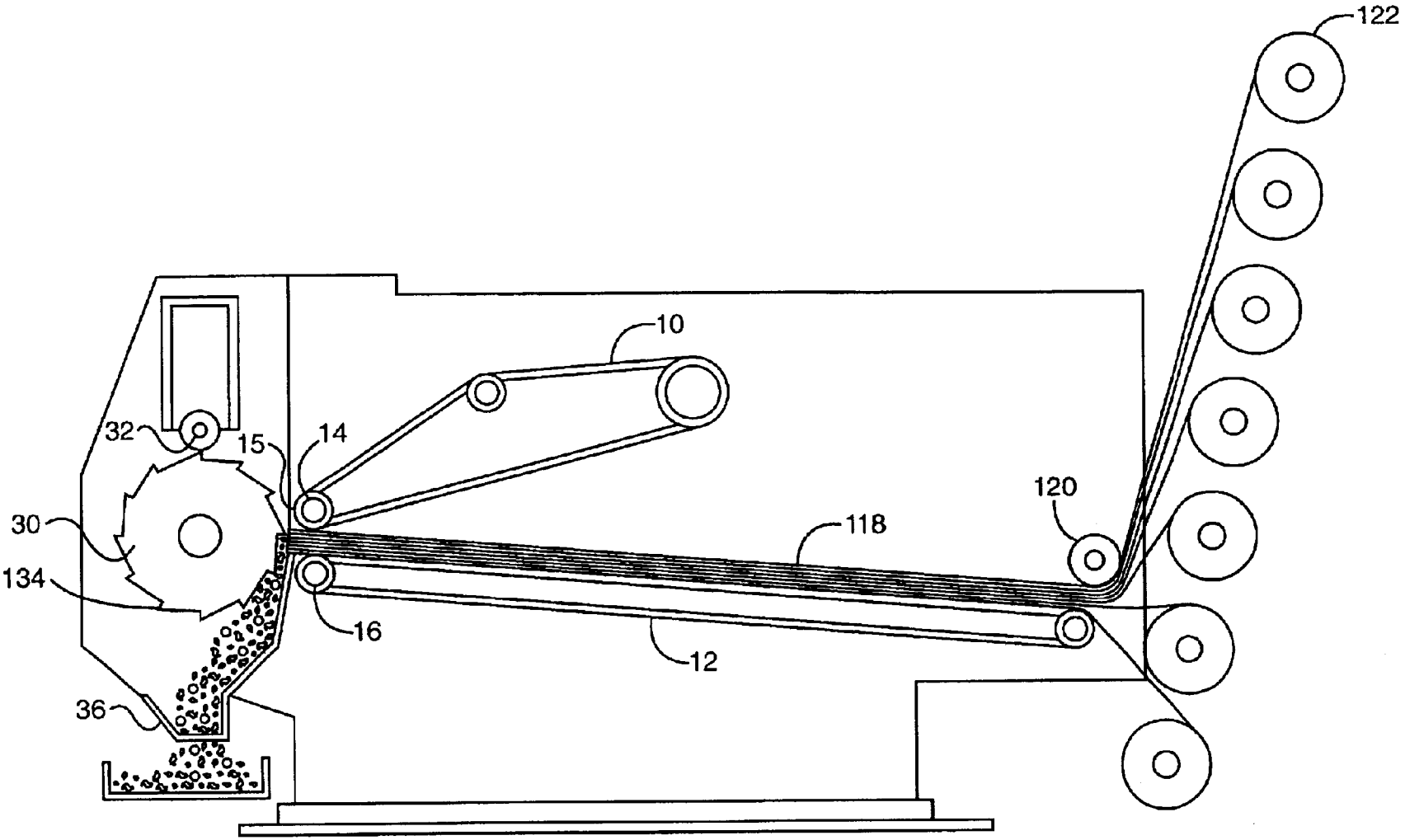
FIG. 4 is a schematic side elevational view of another embodiment of the reconstituted tobacco cutting apparatus in accordance with the present invention.

In a first embodiment, containers of compressed rectangular sheets of conventional reconstituted tobacco are shipped to and emptied at a primary processing facility. In a second embodiment, the master roll is packaged and transferred to the primary processing facility where it is cut into a plurality of daughter rolls, each having a sheet width approximating the width of the mouth opening of a tobacco cutting machine. Then the plurality of daughter rolls are unrolled forming a plurality of continuous sheets. These continuous sheets can be a semi-continuous or continuous web positioned in a layered orientation on a lower conveyor of a tobacco cutting machine. The sheets are then fed into a compression band of a tobacco cutting machine such as a rotary drum cutter 30 as shown in FIGS. 1 and 4.

In the alternative, the master roll may be cut along its width into daughter rolls at the reconstituted tobacco processing facility and then shipped to a primary processing facility. A further alternative is to ship master rolls or daughter rolls to the primary processing facility and then cut either the master roll or daughter rolls into rectangular sheets having a width approximately that of the mouth opening of the tobacco cutter 30 and a length appropriate for feeding to the tobacco cutter 30.

It is realized that alternative methods exist for converting the continuous sheet of reconstituted tobacco exiting pre-drying into the equivalent of daughter rolls with or without first making a master roll which are well known in the art of converting. In either scenario, the rectangular sheets of reconstituted tobacco or daughter rolls of reconstituted tobacco are then cut into shreds using conventional tobacco cutters equipped with controlled-strand length knives such as cutting knives 34 or 134 shown in FIGS. 2 and 3.

The moisture content of the reconstituted tobacco daughter rolls or continuous sheets is preferably between 13 and 15%. More preferable, the moisture content is between 13.5 and 14.5%. At this moisture range, the reconstituted tobacco creates less dust and attrition when it is cut into strands appropriate for blending with cut tobacco. Moreover, the reconstituted tobacco pieces are at a proper moisture content for blending with cut tobacco.

Afterward, a pre-selected amount of the cut reconstituted tobacco is blended with a pre-selected amount of cut tobacco. The above processing steps for reconstituted tobacco eliminates the attrition during conventional reconstituted tobacco processing at a reconstituted tobacco processing facility by bypassing cutting, final drying and packaging steps and of conventional reconstituted tobacco during conventional processing at a primary-processing facility by bypassing processing up through cut-tobacco drying.

In FIG. 1 is shown a multiple layered stack of reconstituted tobacco sheets 18 being fed by a lower conveyor 12 to a rotary cutting drum 30. The lower conveyor 12 moves upwardly to converge with an upper conveyor 10 at the downstream end for feeding the rotary cutter 30. A throat 15 at the downstream end is defined by upper and lower pressure plates 14 and 16 which are mounted to apply pressure to the multiple layer stack of reconstituted tobacco 18 as it passes therethrough.

The rotary drum cutter 30 includes a plurality of cutting knives 34 which are mounted for cutting shreds of tobacco 42 from the multiple layers of reconstituted tobacco sheets 18. The spacing between knives 34 is substantially equal to the width of the mouth opening into the tobacco cutter 30. The tobacco shreds 42 are collected in a hopper 36 which feeds a discharge conveyor, drums, or the like, for further processing or blending with other types of tobacco in a cigarette smoking article or the like. Also, a grinding wheel 32 is mounted above the rotary cutter 30 for traversing along the knives as they rotate.

Figure 2:
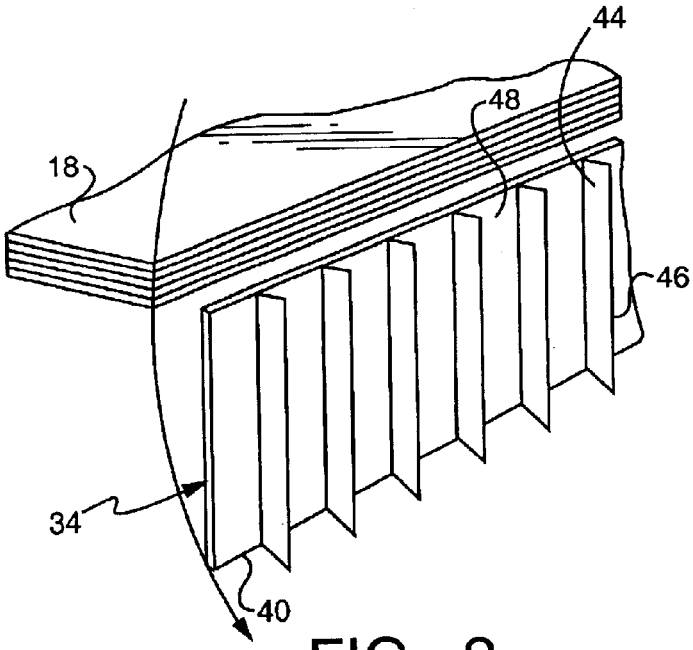
FIG. 2 is a partial sectional view, in perspective, of the controlled-strand length cutting knife of FIG. 1.
Figure 5:
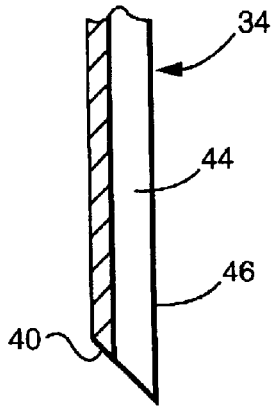
FIG. 5 is a side view of the cutting knife of FIG. 2.

In FIGS. 2 and 5 is shown one particular cutting knife 34 for attachment to the rotary cutter 30. The knife 34 is provided with a lower transversely extending cutting edge 40 which extends substantially the entire width of the layer of reconstituted tobacco sheets 18. Spaced along the cutting knife 34 are a plurality of outwardly extending blade portions 44 having longitudinally extending cutting edges 46.

The spacing 48 between the cutting blade portions 44 define the length of the strands of reconstituted tobacco shreds 42 exiting from the rotary drum 30.

Figure 3:
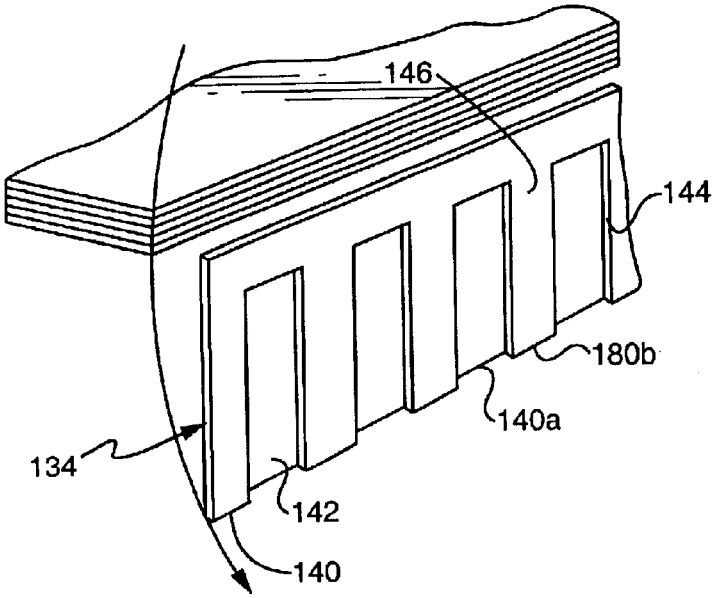
FIG. 3 is a partial sectional view, in perspective, of another controlled-strand length cutting knife used in the cutting apparatus of FIG. 1.
Figure 6:
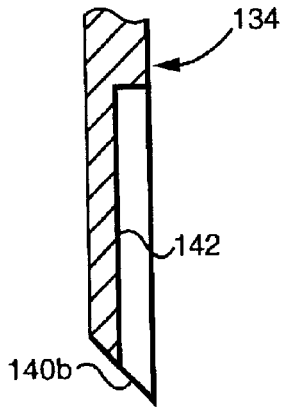
FIG. 6 is a side view of the cutting knife of FIG. 3.

FIGS. 3 and 6 show another cutting knife 134 for attachment to the rotary cutter 30. The knife 134 is beveled at one side and is provided with rectangular section grooves 142 which are cut at right angles to the cutting edge in the face of the knife which is not beveled. The grooves 142 produce a crenellated cutting edge 140 with alternate leading cutting edges 140*a* and 140*b*.

FIG. 4 shows an apparatus for cutting reconstituted tobacco in the same manner as the multiple layer of sheets 18 being cut in FIG. 1, but includes a stack of a plurality of sheets 118 which are formed from continuous rolls 122 of reconstituted tobacco as opposed to the cut sheet shown in FIG. 1. In FIG. 4 a guide roller 120 is spaced above the feed end of the lower conveyor 12 to assist in the alignment of the sheets 118.

FIG. 7 shows one attachment of a cutting knife to a rotary drum 30 which is outlined in phantom lines. Knife 134 with the lower cutting edge 140*b* in contact with stacked sheets of reconstituted tobacco 118 may be attached to the rotary drum by any desired means, but is shown as being attached with bolt means 150.

It is realized that other cutting knives of different configurations may be utilized in the present invention as long as the cutting blades are provided with cutting edges at selected intervals to provide the cuts or strands of tobacco of selected length. The width of the strands is achieved by adjustment of the tobacco-cutting machine, which is well known in the art.

Although the invention has been described in detail with reference to one embodiment, variations and modifications exist within the scope and spirit of the invention as described and defined in the claims appended hereto.

What is claimed is:

1. A method of processing reconstituted tobacco, comprising the steps of:

a. drying reconstituted tobacco to a pre-selected moisture content;

b. forming sheets of reconstituted tobacco;

c. cutting said sheets;

d. transferring said sheets to a primary processing facility;

e. feeding reconstituted tobacco in a plurality stack of cut layered sheets to a tobacco cutting machine;

f. cutting said layered sheets in said tobacco cutting machine to a pre-selected length of strands of reconstituted tobacco, said cutting machine comprising a rotary drum having a plurality of controlled strand length cutting knives spaced at pre-selected intervals along an outer periphery of said rotary drum; and, g. blending said cut reconstituted tobacco with conventional cut tobacco.

2. The method of claim 1, said pre-selected moisture content being 13% to 15% by weight moisture.

3. The method of claim 1, said cutting said sheets being to a pre-selected width.

4. The method of claim 1, said cutting including cutting said reconstituted tobacco into sheets having a width approximately equal to the width of a mouth opening of said tobacco cutting machine.

5. The method of claim 1, said forming including rolling said reconstituted tobacco into a single sheet roll to make a master roll.

6. The method of claim 5, including cutting said master roll into a plurality of daughter rolls each having a sheet width approximately equal to a mouth opening of said tobacco cutting machine.

7. The method of claim 1 wherein each of said controlled strand length cutting knives includes a transversely extending cutting edge extending the width of said layered sheets, said knives including a plurality of spaced outwardly extending blade portions having longitudinally extending cutting edges.

8. The method of claim 1 wherein each of said controlled strand length cutting knives includes a beveled cutting edge at one side and a plurality of grooves of rectangular configuration, said grooves being at right angles to a cutting edge in a face of each of said knives which is not beveled.

9. The method of claim 1 wherein said tobacco cutting machine utilizes a feeder comprising an upper and a lower conveyor converging with a defined spacing therebetween to feed said reconstituted tobacco to a rotary cutter.

10. The method of claim 1 wherein said plurality of layered sheets are fed from a plurality of rolls of reconstituted tobacco.

* * * * *